US009455493B2

(12) United States Patent
Martiskainen et al.

(10) Patent No.: US 9,455,493 B2
(45) Date of Patent: Sep. 27, 2016

(54) DUAL BRANCH COMMON CONDUCTOR ANTENNA

(71) Applicant: Galtronics Corporation Ltd., Tempe, AZ (US)

(72) Inventors: Matti Martiskainen, Tiberias (IL); Jongmin Na, Suwon-si (KR); Eeungyu Bae, Suwon-si (KR)

(73) Assignee: GALTRONICS CORPORATION, LTD., Tiberias (IL)

( * ) Notice: Subject to any disclaimer, the term of this patent is extended or adjusted under 35 U.S.C. 154(b) by 0 days.

(21) Appl. No.: 14/601,778

(22) Filed: Jan. 21, 2015

(65) Prior Publication Data

US 2015/0207210 A1 Jul. 23, 2015

Related U.S. Application Data

(60) Provisional application No. 61/954,685, filed on Mar. 18, 2014, provisional application No. 61/944,638, filed on Feb. 26, 2014, provisional application No. 61/930,029, filed on Jan. 22, 2014, provisional application No. 61/971,650, filed on Mar. 28, 2014.

(51) Int. Cl.

| | |
|---|---|
| ***H01Q 1/24*** | (2006.01) |
| ***H01Q 5/371*** | (2015.01) |
| ***H01Q 21/30*** | (2006.01) |
| ***H01Q 7/00*** | (2006.01) |
| ***H01Q 5/307*** | (2015.01) |
| ***H01Q 13/10*** | (2006.01) |
| ***H01Q 9/42*** | (2006.01) |

(52) U.S. Cl.

CPC ..... *H01Q 1/243* (2013.01); *H01Q 5/307* (2015.01); *H01Q 5/371* (2015.01); *H01Q 7/00* (2013.01); *H01Q 9/42* (2013.01); *H01Q 13/10* (2013.01); *H01Q 21/30* (2013.01)

(58) Field of Classification Search

CPC ..... H01Q 1/24; H01Q 1/241; H01Q 1/242; H01Q 1/243; H01Q 5/30; H01Q 21/30

USPC ..... 343/702

See application file for complete search history.

(56) References Cited

U.S. PATENT DOCUMENTS

| | | | | |
|---|---|---|---|---|
| 2001/0007445 | A1* | 7/2001 | Pankinaho | H01Q 1/243 343/844 |
| 2005/0259013 | A1* | 11/2005 | Gala Gala | H01Q 1/243 343/702 |
| 2011/0001673 | A1 | 1/2011 | You et al. | |
| 2011/0018777 | A1* | 1/2011 | Brown | H01Q 7/00 343/788 |
| 2011/0263289 | A1* | 10/2011 | Vance | H01Q 1/243 455/550.1 |
| 2012/0081252 | A1* | 4/2012 | Pan | H01Q 1/36 343/700 MS |
| 2012/0235866 | A1* | 9/2012 | Kim | H01Q 1/243 343/700 MS |

(Continued)

OTHER PUBLICATIONS

U.S. Appl. No. 14/601,799, filed Jan. 21, 2015.
USPTO, Office Action for U.S. Appl. No. 14/601,799 mailed Mar. 25, 2015.
USPTO, Final Office Action for U.S. Appl. No. 14/601,799 mailed Sep. 8, 2015.
U.S. Appl. No. 14/601,758, filed Jan. 21, 2015.
USPTO, Office Action for U.S. Appl. No. 14/601,758 mailed Mar. 25, 2015.
USPTO, Final Office Action for U.S. Appl. No. 14/601,758 mailed Sep. 24, 2015.
U.S. Appl. No. 14/601,812, filed Jan. 21, 2015.

*Primary Examiner* — Dameon E Levi
*Assistant Examiner* — Collin Dawkins
(74) *Attorney, Agent, or Firm* — Lorenz & Kopf, LLP.

(57) ABSTRACT

A dual branch antenna is provided. The dual branch antenna may include a continuous conductive element divided into first and second branches. Each branch may be configured to form at least a portion of an antenna structure. Antenna structures thus formed may be configured to radiate in at least two different frequencies.

19 Claims, 7 Drawing Sheets

(56) References Cited

U.S. PATENT DOCUMENTS

2012/0299785 A1* 11/2012 Bevelacqua ..... H01Q 9/42 343/702
2012/0306521 A1 12/2012 Nickel
2012/0306709 A1* 12/2012 Wu ..... H01Q 1/243 343/767
2013/0057437 A1 3/2013 Chiu et al.
2013/0135158 A1 5/2013 Faraone et al.

* cited by examiner

DUAL BRANCH COMMON CONDUCTOR ANTENNA

RELATED APPLICATIONS

This application claims the benefit of priority under 35 U.S.C. §119(e) to U.S. Provisional Application No. 61/954,685, filed Mar. 18, 2014, U.S. Provisional Application No. 61/944,638, filed Feb. 26, 2014, U.S. Provisional No. 61/930,029, filed Jan. 22, 2014, and to U.S. Provisional Application No. 61/971,650, filed Mar. 28, 2014, the disclosures of each of which are incorporated herein by reference.

TECHNICAL FIELD

The present disclosure relates to antenna structures for wireless devices. Wireless devices described herein may be used for mobile broadband communications.

SUMMARY

Embodiments of the present disclosure may include a wireless device. The wireless device may include a continuous conductive element and a feed-conveying element intersecting the continuous conductive element at an intermediate location thereof. The feed conveying element may divide the continuous conductive element into a first branch and a second branch. The first branch may extend from the intersection in a first direction and may be configured to serve as a portion of a first antenna configured to resonate at a first frequency. The second branch may extend from the intersection in a second direction different from the first direction and may be configured to serve as a portion of a second antenna configured to resonate at a second frequency that is different from the first frequency.

DETAILED DESCRIPTION OF THE EMBODIMENTS

Reference will now be made in detail to exemplary embodiments of the present disclosure, examples of which are illustrated in the accompanying drawings. Wherever possible, the same reference numbers will be used throughout the drawings to refer to the same or like parts.

Embodiments of the present disclosure relate generally to wide bandwidth antennas provided for use in wireless devices. Multi-band antennas consistent with the present disclosure may be employed in mobile devices for cellular communications, and may operate at frequencies ranging from approximately 700 MHz to approximately 2.7 GHz.

Multi-band antennas consistent with the present disclosure may further be employed for any type of application involving wireless communication and may be constructed to operate in appropriate frequency ranges for such applications. Multi-band antennas consistent with the present disclosure may include dual branched antennas configured to operate in multiple frequency bands.

As used herein, the term antenna may collectively refer to the structures and components configured to radiate radiofrequency energy for communications. The term antenna may collectively refer to the multiple conductive components and elements combining to create a radiating structure. The term antenna may further include additional tuning, parasitic and trim elements incorporated into a wireless device to improve the function of radiating structures. The term antenna may additionally include discreet components, such as resistors, capacitors, and inductors and switches connected to or incorporated with antenna components. As used herein, the term antenna is not limited to those structures that radiate radiofrequency signals, but also includes structures that serve to feed signals to radiating structures as well as structures that serve to shape or adjust radiation patterns.

Multi-band antennas consistent with the present disclosure may be efficacious for providing wideband communications in cellular frequency ranges, e.g., between 700 MH and 2.7 GHz. Multi-band antennas consistent with the present disclosure may be incorporated into wireless devices, such as mobile phones and tablets.

Figure 1A:
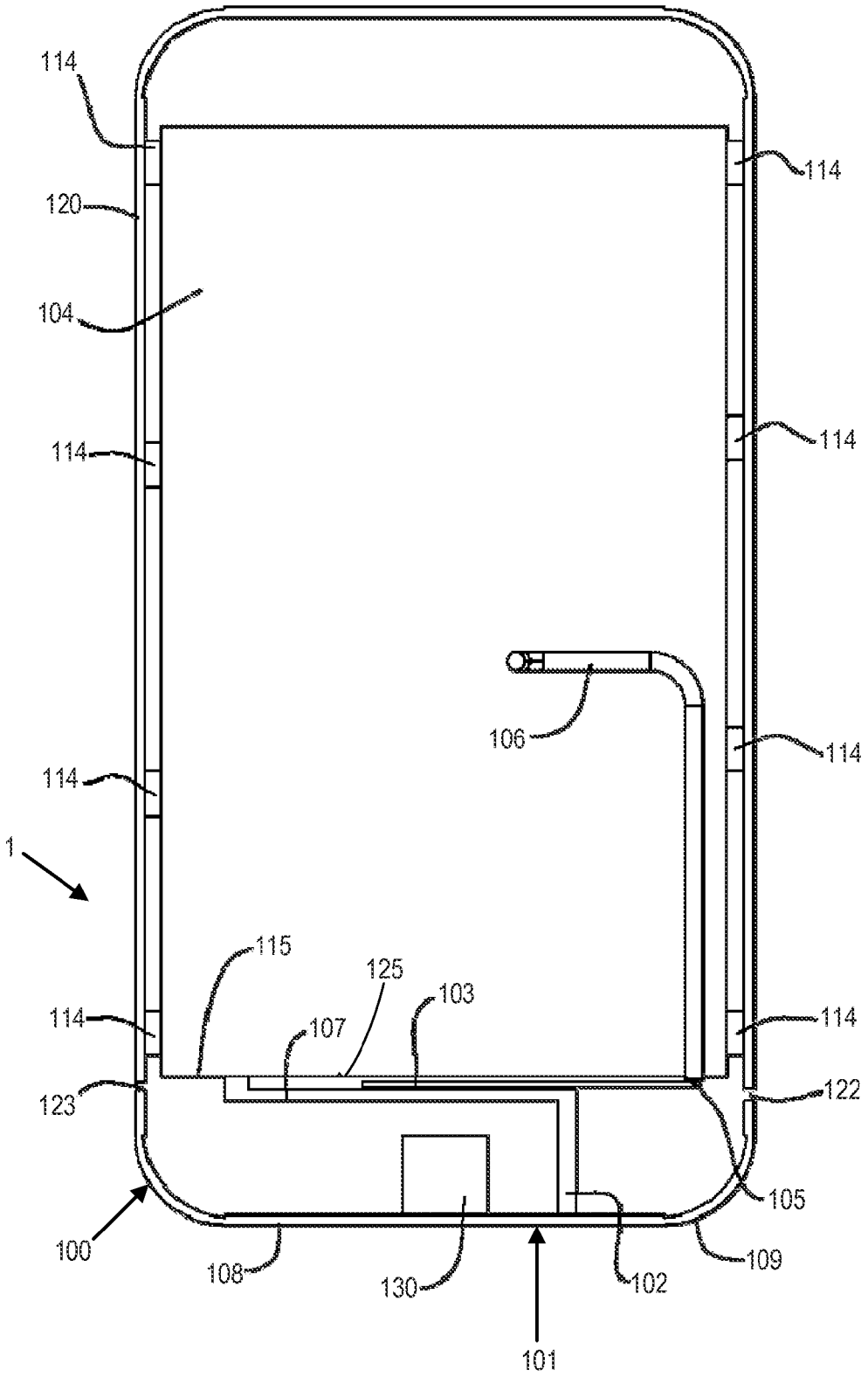
FIGS. 1*a* and 1*b* illustrate of a dual branch antenna consistent with the disclosure.
Figure 1B:
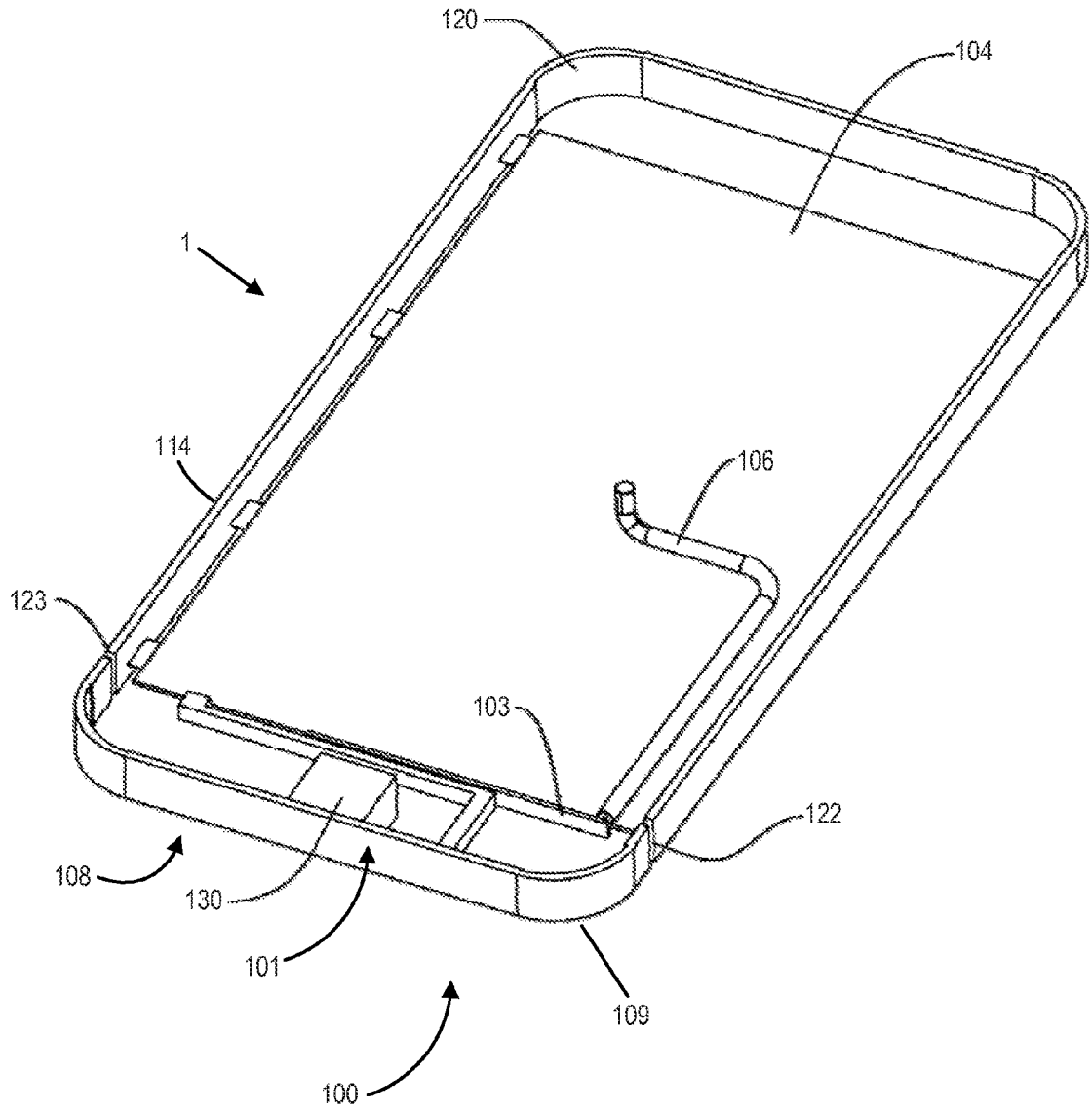

FIGS. 1*a* and 1*b* illustrate an exemplary dual branch antenna of a wireless device consistent with the present specification. FIG. 1*a* provides an overhead view, while FIG. 1*b* provides a perspective view. Dual branch antenna 100 may be included in a wireless device 1 as illustrated in FIG. 1*b*. As illustrated in FIG. 1*a*, a dual branch antenna 100 may be configured to radiate in two or more frequency bands. Dual branch antenna may be configured to radiate in a low frequency band, e.g. between approximately 600 and 1200 MHz, and may be configured to radiate in a high frequency band, e.g. between approximately 1700-2800 MHz. A person of skill in the art will recognize that the frequency ranges provided throughout this disclosure are exemplary only and are not intended to limit the scope of the disclosure. Antennas consistent with the disclosure may be adjusted or altered to provide communications in alternate frequency ranges as may be appropriate.

Dual branch antenna 100 may include a continuous conductive element 101, a feed-conveying element 102, an elongate feed element 103, and a counterpoise 104. Elongate feed element 103 may be connected to feed point 105, which in turn may connect to feed line 106. Feed line 106 may carry radiofrequency signals to and from processing elements of a device in which antenna 100 is included. Feed conveying element 102 may include a first end intersecting continuous conductive element 101 at an intermediate location of continuous conductive element 101 and may include a second end connected to a coupling element 107.

At the intersection point between feed-conveying element 102 and continuous conductive element 101, feed-conveying element 102 may divide continuous conductive element 101 into first branch 108 and second branch 109. First branch 108 may extend from the intersection in a first direction and second branch 109 may be configured to extend from the intersection in a second direction, different than the first. Thus, continuous conductive element 101 may split at an intersection with feed-conveying element 102 to form a dual branch antenna structure. In some embodiments, e.g., as shown in FIG. 1*a*, continuous conductive element 101 may form a T-shaped intersection with feed conveying element 102. Such a T-shaped intersection however, is not required, and an intersection between continuous conductive element 101 and feed conveying element 102 may take several different shapes, for example a Y-shaped intersection.

In some embodiments, dual branch antenna 100 may incorporate a power connector 130 galvanically connected or electrically coupled to continuous conductive element 101 of wireless device 1 as a conductive element. As illustrated in FIG. 1*a*, power connector 130 may galvanically connected or coupled to second branch 109. As used herein, "galvanically connected" may refer to components that are mechanically connected to one another such that a continuously conductive pathway is formed. In some embodiments, the location of power connector 130 as a conductive element of dual branch antenna 100 may enhance the function of the antenna. In some embodiments, power connector 130 may be a radiating element of dual branch antenna 100. In alternative embodiments, power connector 130 may be incorporated into any other conductive element of dual branch antenna 100 or may be provided at a location so as not to substantially affect dual branch antenna 100. In some embodiments, any type of external connector, including data connectors and head phone connectors, for example, may be included as conductive and/or radiating elements.

As discussed above, dual branch antenna 100 may include counterpoise 104. Counterpoise 104 may be a conductive element forming at least a portion of a grounding region of antenna 100. Counterpoise 104 may be formed on a substrate and may be formed of various structures within a wireless device housing dual branch antenna 100. Counterpoise 104 may include ground edge 115. Ground edge 115 may be, as illustrated in FIG. 1*a*, a substantially straight, elongated edge of counterpoise 104. In other embodiments, ground edge 115 may have a curved, wavy, labyrinthine, or other non-linear configuration. In some embodiments, ground edge 115 may have linear and non-linear portions. In some embodiments, counterpoise 104 may be galvanically connected to, at chassis ground connection 114, a device chassis 116. In some embodiments, counterpoise 104 may be connected to device chassis 116 by multiple chassis ground connections 114. While FIG. 1*a* illustrates counterpoise 104 as a regular, elongated rectangle, counterpoise 104 may be formed of any suitable shape and size. In particular, counterpoise 104 may be configured to accommodate other components located within a wireless device.

Device chassis 116 may be a conductive chassis, and may include one or many interconnected conductive elements. Device chassis 116 may form at least a portion of an internal structure of a housing of wireless device 1. Device chassis 116 may be distributed throughout an interior of wireless device 1, and may provide structural rigidity to wireless device 1. Device chassis 116 may include components in common with counterpoise 104, continuous conductive element 101 and/or other antenna structures. Device chassis 116 may also form at least a portion of or an entirety of a housing of wireless device 1. In some embodiments, device chassis 116 may include device frame 120, which may be a conductive frame located at a periphery of wireless device 1. In some embodiments, a device frame 120 may be located at an external periphery of wireless device 1, and may therefore form at least a portion of an external housing of wireless device 1. In alternative embodiments, device frame 120 may be located along an internal periphery of wireless device 1, and surround many of the components of wireless device 1, but residing within an external housing or case. Device frame 120 may also serve as a bezel for securing a screen or face of wireless device 1. Device chassis 116 may include conductive elements in galvanic communication with one another, and may include additional conductive elements not in galvanic communication with the entirety of device chassis 116. Device chassis 116 may be electrically coupled, galvanically or otherwise, to other conductive elements of wireless device 1 to serve as at least a portion of a radiating antenna structure. For example, a device chassis 116 may form all of or at least a portion of a conductive frame, and may be configured to radiate. As used herein, "electrically coupled" refers to elements that are configured so as to permit the transfer of current from one to the other. Galvanic coupling, for example, may involve a direct conductive connection. Elements may also be, for example, capacitively or inductively coupled, and may be coupled without a direct physical connection. For example, two elements arranged in proximity to one another may couple together and permit the transfer of current from one to the other.

Counterpoise 104 may form at least a portion of a radiating structure of antenna 100. Counterpoise 104 and wireless device chassis 116 may be configured to be of appropriate electrical lengths to form, each alone or together in combination, at least a portion of a resonance structure. As used herein, electrical length refers to the length of a feature as determined by the portion of a radiofrequency signal that it may accommodate. For example, a feature may have an electrical length of $\lambda/4$ (e.g., a quarter wavelength) at a specific frequency. An electrical length of a feature may or may not correspond to a physical length of a structure, and may depend on radiofrequency signal current pathways. Features having electrical lengths that appropriately correspond to intended radiation frequencies may operate more efficiently. Thus, a structural element of antenna 100 may be sized to be of an appropriate electrical length for a frequency range at which the structure is designed to radiate.

Continuous conductive element 101 may be located entirely or partially within a housing of wireless device 1. Continuous conductive element 101 may include portions located on an exterior of wireless device 1. For example, portions of continuous conductive element 101 may be located in or on a device frame 120 of device 1. Portions of continuous conductive element 101 may be embedded within a housing or casing of wireless device 1. For example, portions of continuous conductive element may be manufactured in a housing of wireless device 1 via laser direct structuring, overmolding, or other manufacturing technique. Portions of continuous conductive element 101 may be included in device frame 120. For example, as illustrated in FIG. 1, first branch 108 and second branch 109 of continuous conductive element 101 may be located at an exterior of wireless device 1, forming a portion of a device frame 120 of wireless device 1. As illustrated in FIG. 1, first branch 108 and second branch 109 of continuous conductive element 101, when located on device frame 120, may terminate at distal ends in frame gaps 122, 123, respectively. Frame gaps 122, 123 may be electrical discontinuities in a conductive frame 120 surrounding wireless device 1. As used herein, "electrical discontinuities" may refer to gaps or other structures substantially preventing the flow of current. In alternative embodiments, first branch 108 and second branch 109 may extend continuously around wireless device 1 to form a gapless conductive frame antenna. In some embodiments, distal ends of first branch 108 and second branch 109 may terminate at the same frame gap 122. That is, in some embodiments, a conductive frame may have a single gap. Portions of continuous conductive element 101 may also be included in device chassis 116.

Coupling element 107 may be arranged or disposed in proximity to a ground edge 115 of counterpoise 104, forming a slit 125 or gap therebetween. Elongate feed element 103 may be disposed between counterpoise 104 and coupling element 107, at least partially within slit 125. Elongate feed element 103 may be galvanically isolated from coupling element 107 and ground edge 115, but may be located in close enough proximity to enable reactive coupling. Although elongate feed element 103 may be located in a same plane as ground edge 115 and coupling element 107, it is not required, and elongate feed element 103 may be located offset from these features. Slit 125 may be partially or completely filled by a dielectric material, such as air, plastic, teflon, or other dielectric.

A multi-band dual branch antenna 101 according to FIG. 1 may operate as follows. Elongate feed element 103 may receive a radiofrequency signal from feed point 105 by way of feed line 106. Coupling element 107, due to its proximity to elongate feed element 103, may couple, either capacitively, inductively, or both, to elongate feed element 103 and thus receive the radiofrequency signal. The radiofrequency signal may be conveyed to continuous conductive element 101 via feed conveying element 102.

In a high frequency band of operation, for example between 1700-2700 MHz, the coupling element 107, feed conveying element 107, first branch 108 and second branch 109 may act as a high-frequency radiating structures. Thus, second branch 109 may be configured to serve as at least a portion of a high-frequency antenna configured to resonate in a high-frequency band. At least a portion of first branch 108 may also be configured to cooperate with second branch 109 to function as a high-band antenna.

In a low frequency band of operation, for example between 700 and 1100 MHz, coupling element 107, feed conveying element 102, and first branch 108 may cooperate to activate counterpoise 104 to radiate in the low frequency band. Thus, these structures may, together, form a low-band loop fed radiator. First branch 108, therefore, may be configured to serve as at least a portion of a low-frequency antenna configured to resonate in a low-frequency band. In some embodiments, second branch 109 may be configured to cooperate with first branch 108 to function as a low-band antenna.

In some embodiments first branch 108 and second branch 109 may be configured to form first and second arms of a two armed monopole radiation structure. Each of first branch 108 and second branch 109 may be configured to function as a monopole when supplied with a radiofrequency signal.

As illustrated in FIGS. 1*a* and 1*b*, elongate feed element 103 may function as a distributed feed element. As shown, the structures radiating as a high-frequency antenna may have elements in common with the structures radiating as a low-frequency antenna. In particular, elongate feed element is common to both frequency ranges. Due to the difference in radiated frequency ranges, and, thus, radiofrequency wavelengths, the elements of high-band and low-band radiation structures may have different locations at which a signal is transferred from elongated feed element 103. The elongated nature of elongate feed element 103 may permit function as a distributed feed element, providing a plurality of locations along its length at which a signal may be transferred. This distributed feed nature may reduce or eliminate the need for impedance matching circuits between elongate feed element 103 and the elements of the high and low band antenna structures.

The geometry and disposition of elongate feed element 103, coupling element 107, ground edge 115, and slit 125 may play an important role in the function of dual branch antenna 100. Elongate feed element 103 may be separated from coupling element 107 by a distance in the range of approximately 0.2-1 mm, corresponding to an electrical distance in the range of approximately 0.0004-0.009λ, where λ is a wavelength corresponding to at least one frequency at which dual branch antenna 100 may radiate. Elongate feed element 103 may have a width of electrical length between approximately 0.0004λ and 0.009λ, or between approximately 0.002-0.0135λ. In some embodiments, elongate feed element 103 may have a width in the range 0.2-1 mm.

Figure 1C:
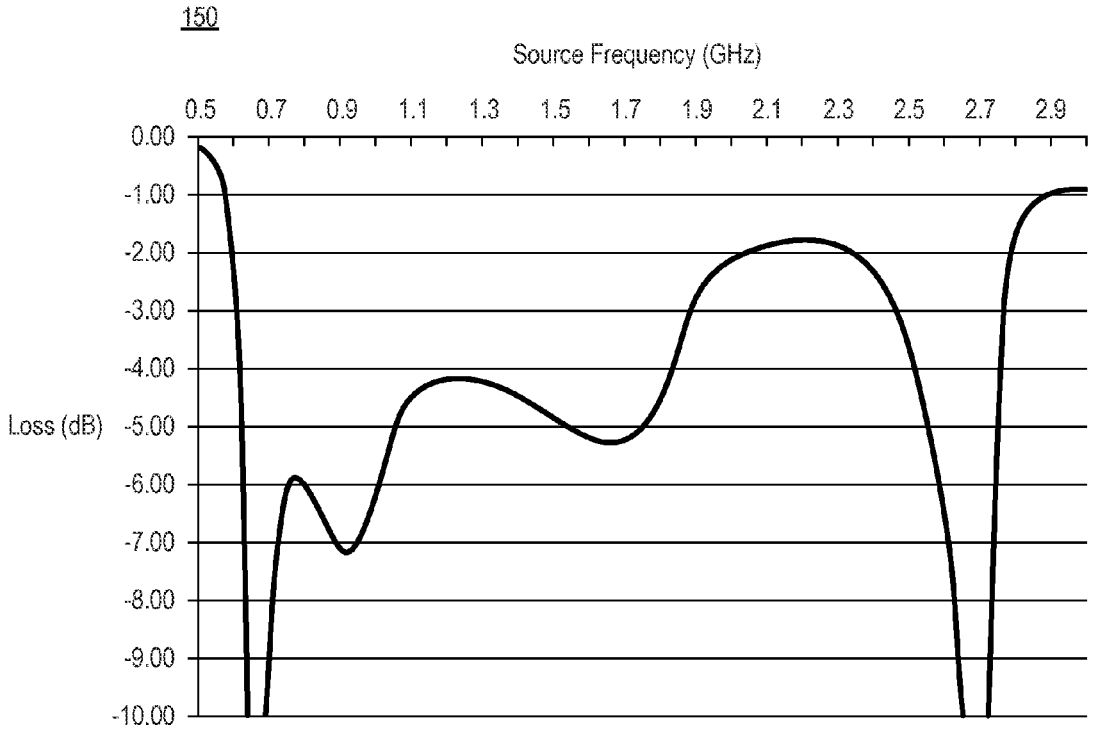
FIG. 1*c* is a graph illustrating an exemplary graph of return loss in a dual branch antenna consistent with the disclosure.

The performance of dual branch antenna 100 may be illustrated by exemplary return loss graph 150, as illustrated in FIG. 1*c*. As shown in FIG. 1*c*, dual branch antenna may resonate in a low frequency band between 600 and 1700 MHz, and in a high frequency band between 2300 and 2800 MHz.

Dual branch antenna 100 may include additional structural components without departing from the scope of this disclosure. For example, dual branch antenna 100 may include at least one additional branch (not shown) extending from an intersection between continuous conductive element 101 and feed conveying element 102. Such an additional branch may be configured to radiate in a third frequency band that is different from the first two frequency bands.

Dual branch antenna 100 presents an exemplary antenna structure consistent with the disclosure, and provides an explanatory example for understanding antenna design and function principles consistent with the disclosure. Dual branch antenna concepts as presented herein may be applied to alternative antenna structures to provide differing results. FIGS. 2*a*-2*c*, 3*a*, and 3*b* illustrate several additional antenna structures consistent with the principles disclosed herein. The exemplary antenna structures illustrated are not intended to be exclusive or limiting, and a person of ordinary skill in the art may apply design principles as disclosed herein to alternate structures without departing from the scope of this disclosure.

Figure 2A:
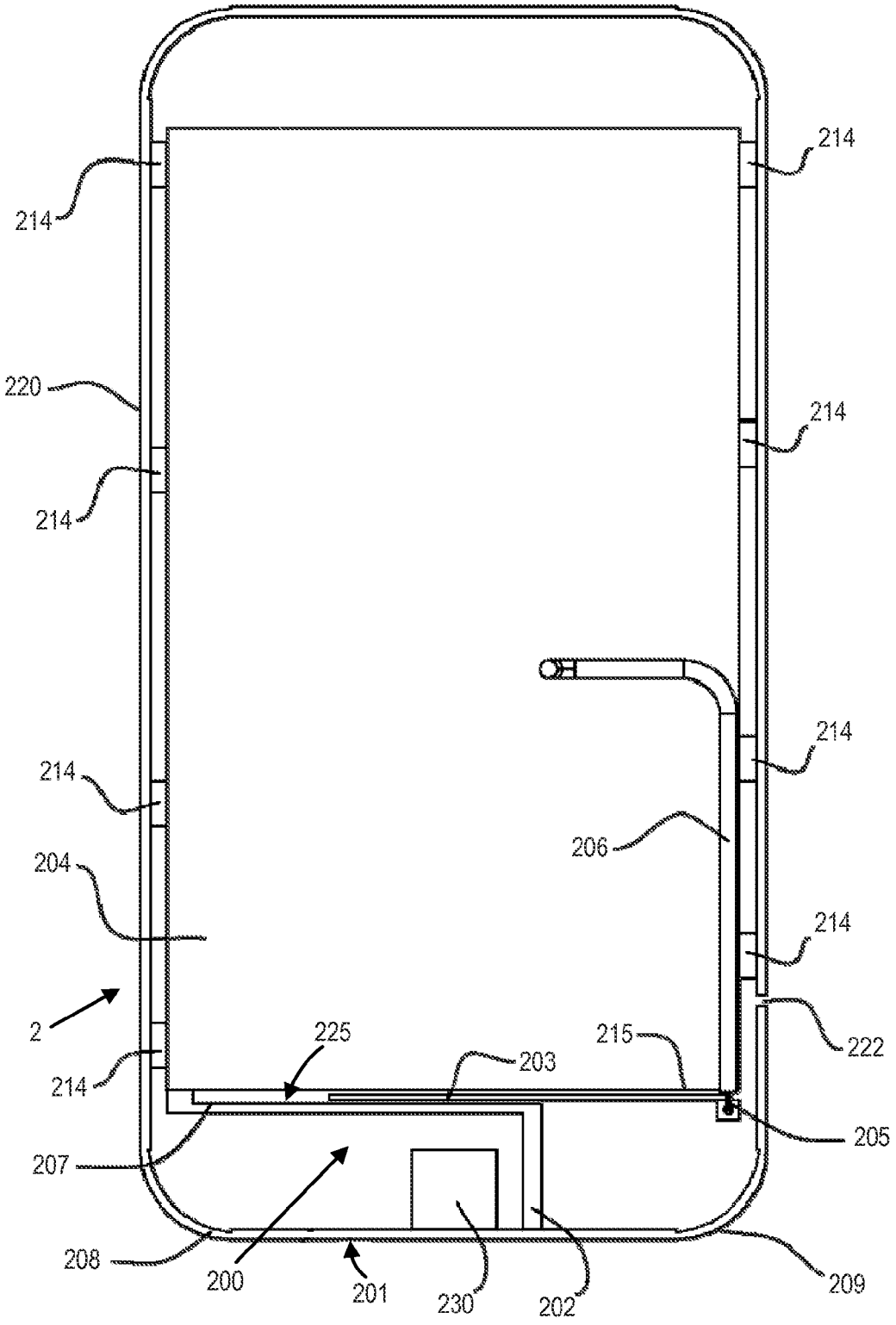
FIGS. 2*a* and 2*b* illustrate of a dual branch antenna consistent with the disclosure.
Figure 2B:
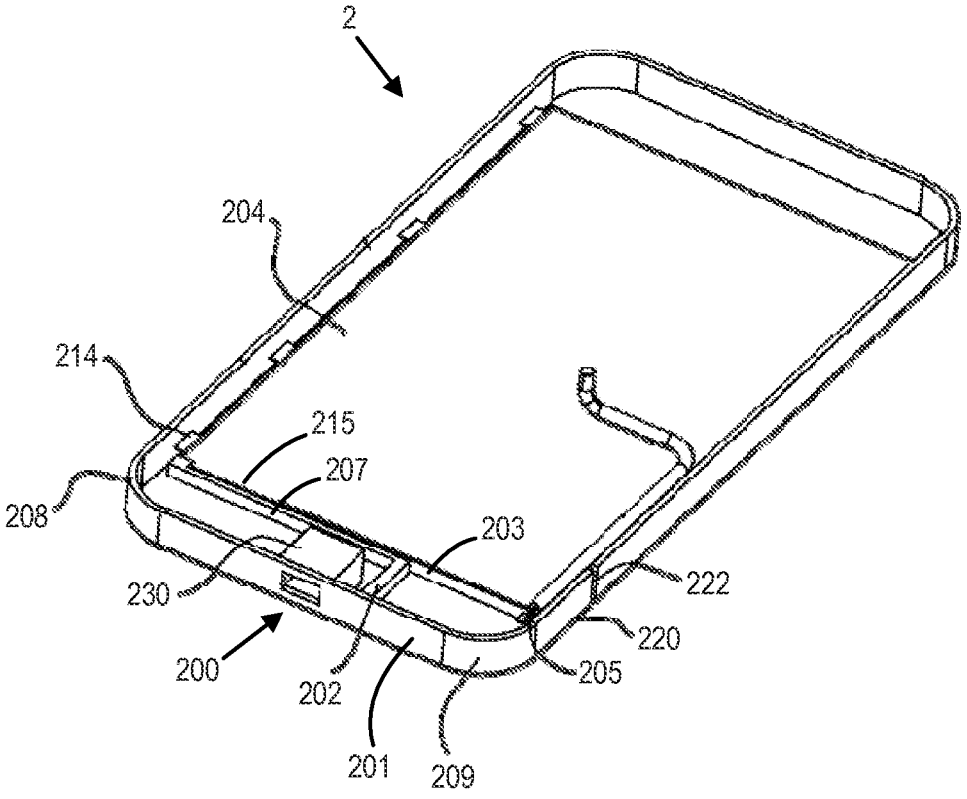

FIGS. 2*a* and 2*b* illustrate an exemplary dual branch antenna 200 of wireless device 2 consistent with the disclosure. Similarly to dual branch antenna 100, dual branch antenna 200 may include counterpoise 204 having a ground edge 215, elongate feed element 203, coupling element 207, feed conveying element 202, continuous conductive element 201, and device frame 120. Continuous conductive element 201 may be divided into a first branch 208 and a second branch 209 at an intersection with feed conveying element 202. Slit 225 may be formed between ground edge 215 and coupling element 207.

A difference between exemplary dual branch antenna 200 and dual branch antenna 200 is that, in dual branch antenna 200, first branch 208 may extend continuously around device frame 120. Thus, dual branch antenna 200 may include a single gap 222 located between a distal end of second branch 209 and a remainder of device frame 220. In dual branch antenna 200, first branch 208 may form a galvanically connected conductive loop including coupling element 207, feed conveying element 202, chassis ground connection 214, and counterpoise 204.

When supplied with a radiofrequency signal, elongate feed element 203 may couple, capacitively, inductively, or both, to coupling element 207, as described above with respect to dual branch antenna 100 and FIGS. 1*a* and 1*b*.

When supplied with a high-band radiofrequency signal, coupling element 207 and feed conveying element 202 may activate one or both of first and second branches 208 and 209 to radiate in a high-band frequency range. Second branch 209, which may remain as an unconnected tail or spur element may radiate in a high-band frequency range as a monopole. First branch 208, in cooperation with chassis ground connection 214, counterpoise 204, coupling element 207 and feed conveying element 202 may form a high-band radiating loop.

When supplied with a low-band radiofrequency signal, coupling element 207, feed conveying element 202, and second branch 209 may cooperate to couple to counterpoise 204 and device frame 220 to activate these structures to radiate in a low band frequency range.

Figure 2C:
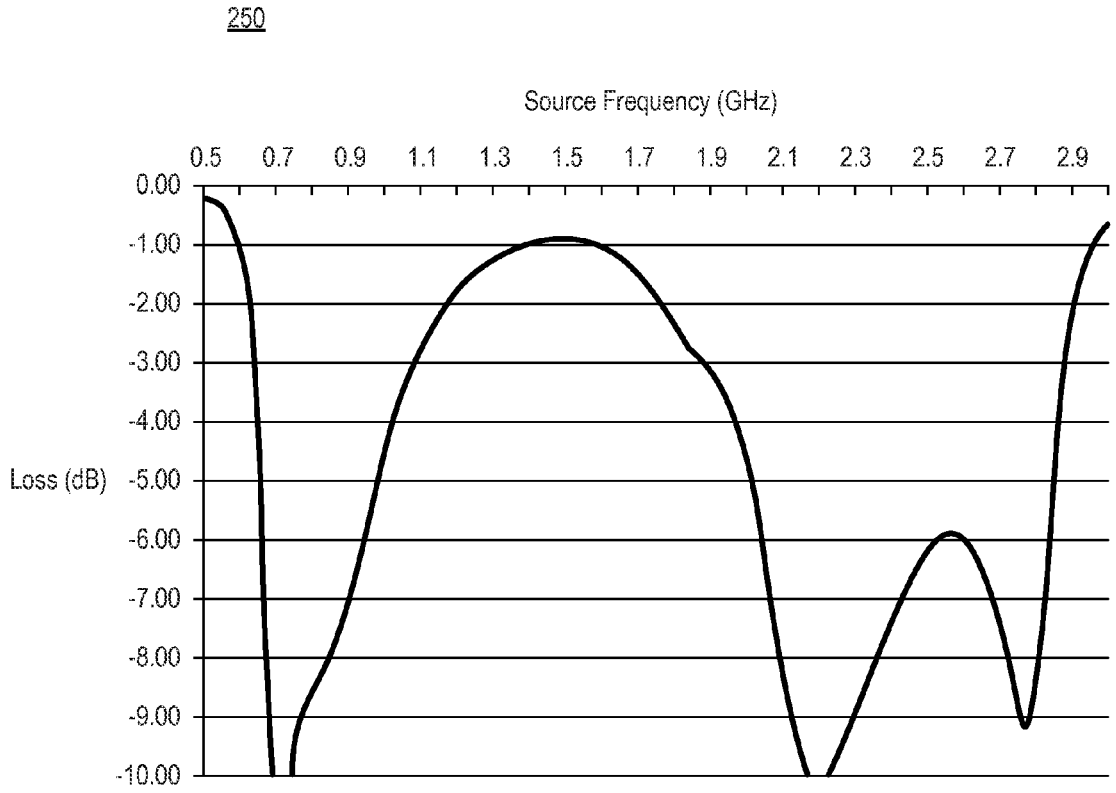
FIG. 2*c* is a graph illustrating an exemplary graph of return loss in a dual branch antenna consistent with the disclosure.

The performance of dual branch antenna 200 may be illustrated by exemplary return loss graph 250, as illustrated in FIG. 2*c*. As shown in FIG. 2*c*, dual branch antenna may resonate in a low frequency band between 600 and 1700 MHz, and in a high frequency band between 1700 and 2800 MHz. As shown in a comparison between return loss graph 150 and return loss graph 250, the inclusion of structures forming high band radiating loop may serve to increase the bandwidth of a high frequency band.

Figure 3A:
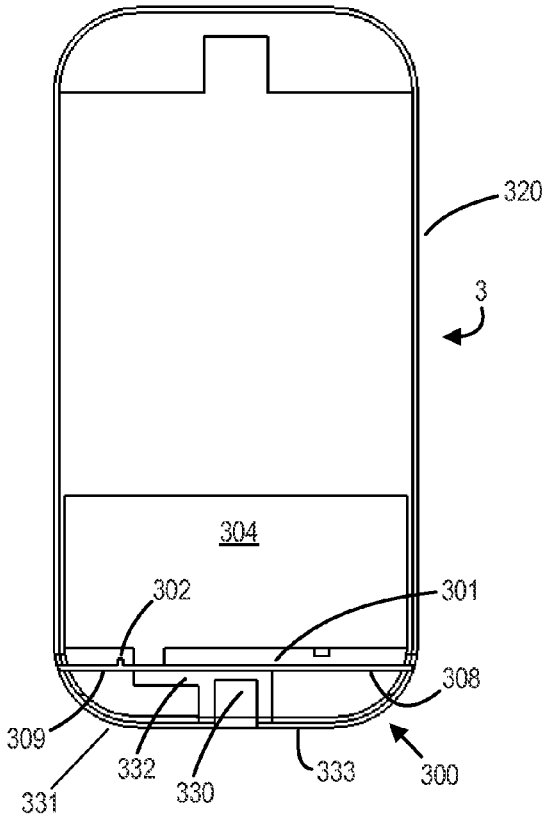
FIGS. 3*a* and 3*b* illustrate a dual branch antenna consistent with the present disclosure.
Figure 3B:
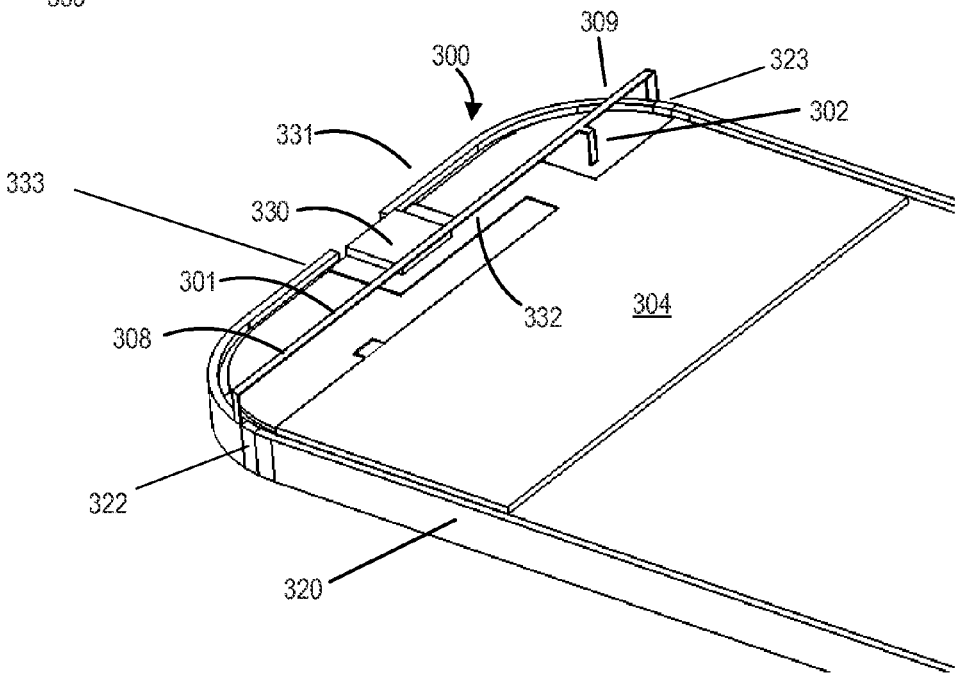

FIGS. 3*a* and 3*b* illustrate another exemplary embodiment of a dual branch antenna consistent with the present disclosure. As illustrated in FIGS. 3*a* and 3*b*, dual branch antenna 300 may be provided in a wireless device 3. Dual branch antenna 300 may include a feed conveying element 302, a continuous conductive element 301, a counterpoise 304, and a device frame 320. Continuous conductive element 301 may include a first branch 308 and a second branch 309.

In contrast to dual branch antennas 100, 200, dual branch antenna 300 may include a feed conveying element 302, which is galvanically coupled to a feed line (not shown). Feed conveying element 302 may meet continuous conductive element 301 at a T-shaped intersection, and first branch 308 and second branch 309 may extend away from the intersection in different directions. First branch 308 and second branch 309 may loop back towards each other, and their conductive paths may continue along device frame 320. Each of first branch 308 and second branch 309 may meet at counterpoise return 332, which may provide a conductive pathway to counterpoise 304 for each of first branch 308 and second branch 309. Because first branch 308 and second branch 309 comprise continuous conductive element 301 and constitute at least a portion of frame 320, portions of continuous conductive element 301 may be located internal to wireless device 3 and portions of continuous conductive element 301 may be located at an external periphery of wireless device 3.

As illustrated in FIG. 3*b*, gaps 322, 323 may separate the portions of device frame 320 constituted by first branch 308 and second branch 309 from the remainder of device frame 320. Gaps 322, 323 may constitute electrical discontinuities in the conductive pathway of device frame 320. Gaps 322, 3233 may include dielectric material, e.g., air, plastic, teflon, or other suitable material. In some embodiments, either gap 322 or gap 323, or both, may not be included, and first branch 308 and second branch 309 may have a conductive connection with the remainder of device frame 320.

First branch 308 may form a form first radiating loop, from feed conveying element 302, along first branch 308, which may constitute at least a portion 333 of a conductive device frame 320, and back to counterpoise 304 via counterpoise return 332. Power connector 330 may be included in the conductive pathway. First branch 308, a first portion of frame 320, and chassis return 332 may therefore cooperate to form a radiating loop. As illustrated in FIG. 3*b*, portions of first branch 308 may be located internal to wireless device 3 and portions may be located at an external periphery of wireless device 3.

Second branch 309 may form a form second radiating loop, from feed conveying element 302, along second branch 309, which may constitute at least a portion 331 of a conductive device frame 320, and back to counterpoise 304 via counterpoise return 332. Power connector 330 may be included in the conductive pathway. Second branch 309, a second portion of frame 320, and chassis return 332 may therefore cooperate to form a radiating loop. As illustrated in FIG. 3*b*, portions of second branch 309 may be located internally to wireless device 3 and portions may be located at an external periphery of wireless device 3. In some embodiments, first branch 308 and second branch 309 may intersect at power connector 330. In some embodiments, at least a portion of first branch 308 may be incorporated in the second radiating loop, and/or at least a portion of the second branch 309 may be incorporated in the first radiating loop.

The first and second radiating loops formed by first and second branches 308, 309, respectively, may intersect at chassis return 332 and share chassis return 332 as a common return path. First and second radiating loops may also form opposing lobe regions of an antenna structure. Portions of first and second radiating loops may also be combined to form a third radiating loop.

A third radiating loop may be formed by a conductive pathway from first branch 308, across chassis return 332, and back to feed conveying element 302 via second branch 309.

Dual branch antenna 300, therefore, may constitute a triple-loop antenna. Each of the first, second, and third radiating loops may have a different electrical length, and may therefore each be configured to serve as antennas radiating at different frequencies. At least one of the first, second and third radiating loops may be configured as at least a portion of a low-band antenna by activating at least a portion of device chassis 320 radiate in a low band frequency range, for example between 700 MHz and 1200 MHz. At least one of the first, second and third radiating loops may be configured to radiate in a high band frequency range, for example between 1700 MHz and 2200 MHz. At least one of the first, second, and third radiating loops may be configured as a second high-band or a second low-band radiating element.

For example, a first radiating loop formed at least partially by first branch 308 and a first portion 333 of device chassis 320 may be configured to serve as a low band antenna. A second radiating loop formed at least partially by second branch 309 and a second portion 331 of device chassis 320 may be configured to serve as a high band antenna. A third radiating loop, formed at least partially by first branch 308, second branch 309, and device frame 320 may be configured to serve as an additional low-band radiating element.

As illustrated in FIGS. 3*a* and 3*b*, dual branch antenna 300, which may be configured as a triple loop antenna, may includes portions in an interior of wireless device 3 and portions on an exterior of wireless device 3. In some embodiments, the radiating elements of dual branch antenna 300, e.g., continuous conductive element 301 and others, may be entirely located within a housing of wireless device 3. In some embodiments, the radiating elements may be located on a PCB substrate. In some embodiments of wireless device 3, device frame 320 may terminate at gaps 322, 323, and a remainder of wireless device 3 may be surrounded by non-conductive housing materials. In some embodiments, device frame 320 may further be configured as a bezel.

The foregoing descriptions of the embodiments of the present application have been presented for purposes of illustration and description. They are not exhaustive and do not limit the application to the precise form disclosed. Modifications and variations are possible in light of the above teachings or may be acquired from practicing the disclosed embodiments. For example, several examples of antennas embodying the inventive principles described herein are presented. These antennas may be modified without departing from the inventive principles described herein. Additional and different antennas may be designed that adhere to and embody the inventive principles as described. Antennas described herein are configured to operate at particular frequencies, but the antenna design principles presented herein are limited to these particular frequency ranges. Persons of skill in the art may implement the antenna design concepts described herein to create antennas resonant at additional or different frequencies, having additional or different characteristics.

Other embodiments of the present application will be apparent to those skilled in the art from consideration of the specification and practice of the embodiments disclosed herein. It is intended that the specification and examples be considered as exemplary only.

What is claimed is:

1. A wireless device, comprising:

a counterpoise;

a continuous conductive element located adjacent to the counterpoise; and a feed-conveying element intersecting the continuous conductive element at an intermediate location thereof, and dividing the continuous conductive element into a first branch and a second branch, the first branch extending from the intersection in a first direction, the first branch galvanically connected to the counterpoise to form a conductive loop with the counterpoise and the feed-conveying element, the first branch being configured to serve as a portion of a first antenna configured to resonate at a first frequency, and the second branch extending from the intersection in a second direction different from the first direction and being configured to serve as a portion of a second antenna configured to resonate at a second frequency, wherein the first frequency differs from the second frequency, wherein the first branch forms a first loop and the second branch form a second loop, the first loop being configured to serve as the first antenna and the second loop being configured to serve as the second antenna, the first and second loops being on opposite sides of an electrical connector of the wireless device, the first and second loops sharing a common return path through the electrical connector.

2. The wireless device of claim 1, wherein the feed conveying element is reactively coupled to a feed.

3. The wireless device of claim 1, wherein the first antenna is a low band antenna and the second antenna is a high band antenna.

4. The wireless device of claim 1, wherein the continuous conductive element includes at least one additional branch configured to serve as a portion of an additional antenna resonant at an additional frequency different than the first frequency and the second frequency.

5. The wireless device of claim 1, wherein at least a portion of the first branch cooperates with the second branch to function as the second antenna.

6. The wireless device of claim 1, further comprising a housing, and wherein the continuous conductive element is arranged at an external periphery of the housing.

7. The wireless device of claim 6, further wherein the counterpoise is disposed within the housing, the counterpoise having at least one edge, and wherein the feed conveying element has a portion that extends along the at least one edge.

8. The wireless device of claim 6, wherein the continuous conductive element constitutes a portion of a bezel on the housing, and the first and second branches each have a distal end separated by a non-conductive discontinuity from other portions of the bezel.

9. The wireless device of claim 6, wherein the continuous conductive element constitutes a portion of a bezel on the housing, the second branch has a distal end separated by a nonconductive discontinuity from other portions of the bezel, and the first branch has a distal end continuous with other portions of the bezel.

10. The wireless device of claim 1, wherein the second branch constitutes a spur.

11. The wireless device of claim 1, wherein the second branch constitutes an electrically disconnected tail.

12. The wireless device of claim 1, wherein the feed conveying element is galvanically connected to a feed.

13. The wireless device of claim 1, further comprising a housing, and wherein the continuous conductive element includes a portion internal to the housing and a frame portion external to the housing.

14. The wireless device of claim 13, wherein the first branch and the second branch share a common return path.

15. The wireless device of claim 1, wherein the feed conveying element is coupled to a substantially non-inductive feed.

16. The wireless device of claim 1, wherein the first branch and the second branch intersect.

17. A wireless device, comprising:

a counterpoise;

a continuous conductive element located adjacent to the counterpoise;

a feed-conveying element intersecting the continuous conductive element at an intermediate location thereof, and dividing the continuous conductive element into a first branch and a second branch, the first branch extending from the intersection in a first direction, the first branch galvanically connected to the counterpoise to form a conductive loop with the counterpoise and the feed-conveying element, the first branch being configured to serve as a portion of a first antenna configured to resonate at a first frequency, and the second branch extending from the intersection in a second direction different from the first direction and being configured to serve as a portion of a second antenna configured to resonate at a second frequency, wherein the first frequency differs from the second frequency; and a housing, wherein the first branch and the second branch share a common return path;

wherein the continuous conductive element includes a portion internal to the housing and a frame portion external to the housing, and wherein the common return path occupies a plane different than that of the feed conveying element.

18. A wireless device, comprising:

a counterpoise;

a continuous conductive element located adjacent to the counterpoise;

a feed-conveying element intersecting the continuous conductive element at an intermediate location thereof, and dividing the continuous conductive element into a first branch and a second branch, the first branch extending from the intersection in a first direction, the first branch galvanically connected to the counterpoise to form a conductive loop with the counterpoise and the feed-conveying element, the first branch being configured to serve as a portion of a first antenna configured to resonate at a first frequency, and the second branch extending from the intersection in a second direction different from the first direction and being configured to serve as a portion of a second antenna configured to resonate at a second frequency, wherein the first frequency differs from the second frequency; and a housing, wherein the first branch and the second branch share a common return path;

wherein the continuous conductive element includes a portion internal to the housing and a frame portion external to the housing, and wherein the first branch, a first portion of the frame, and the return path cooperate to define a first radiating loop, and wherein the second branch, a second portion of the frame, and the return path cooperate to define a second radiating loop.

19. The wireless device of claim 18, wherein a first portion of the first radiating loop includes an external bezel and a second portion of the first radiating loop is internal to the housing.

* * * * *